United States Patent [19]

Brobeck

[11] 4,195,533

[45] Apr. 1, 1980

[54] OPERATIVE MEMBERS FOR USE IN A QUICK SHUT-OFF APPARATUS

[75] Inventor: Helmut Brobeck, Hessheim, Fed. Rep. of Germany

[73] Assignee: Aktiengesellschaft Kuhnle, Kopp & Kausch, Frankenthal, Fed. Rep. of Germany

[21] Appl. No.: 893,763

[22] Filed: Apr. 5, 1978

[30] Foreign Application Priority Data

Apr. 6, 1977 [DE] Fed. Rep. of Germany ..... 2715421

[51] Int. Cl.[2] ..... G05G 17/00

[52] U.S. Cl. ..... 74/3.2; 74/575; 137/57

[58] Field of Search ..... 74/3, 3.2, 575; 137/57; 145/36; 264/474.4, 475.5

[56] References Cited

U.S. PATENT DOCUMENTS

| | | | |
|---|---|---|---|
| 1,637,909 | 8/1927 | Linn | 74/3 |
| 2,317,812 | 4/1943 | Schmid | 74/3 |
| 3,821,973 | 7/1974 | Carmien | 145/36 X |
| 3,844,321 | 10/1974 | Cook | 145/36 X |

*Primary Examiner*—Allan D. Herrmann
*Attorney, Agent, or Firm*—Albert L. Jeffers

[57] ABSTRACT

An operative member for a quick shut-off apparatus for steam turbines formed of a non-arcing solid material having a predetermined characteristic value determined by the breaking elongation, breaking stress, modulus of elasticity and specific weight, such as an extruded polyamide.

10 Claims, 1 Drawing Figure

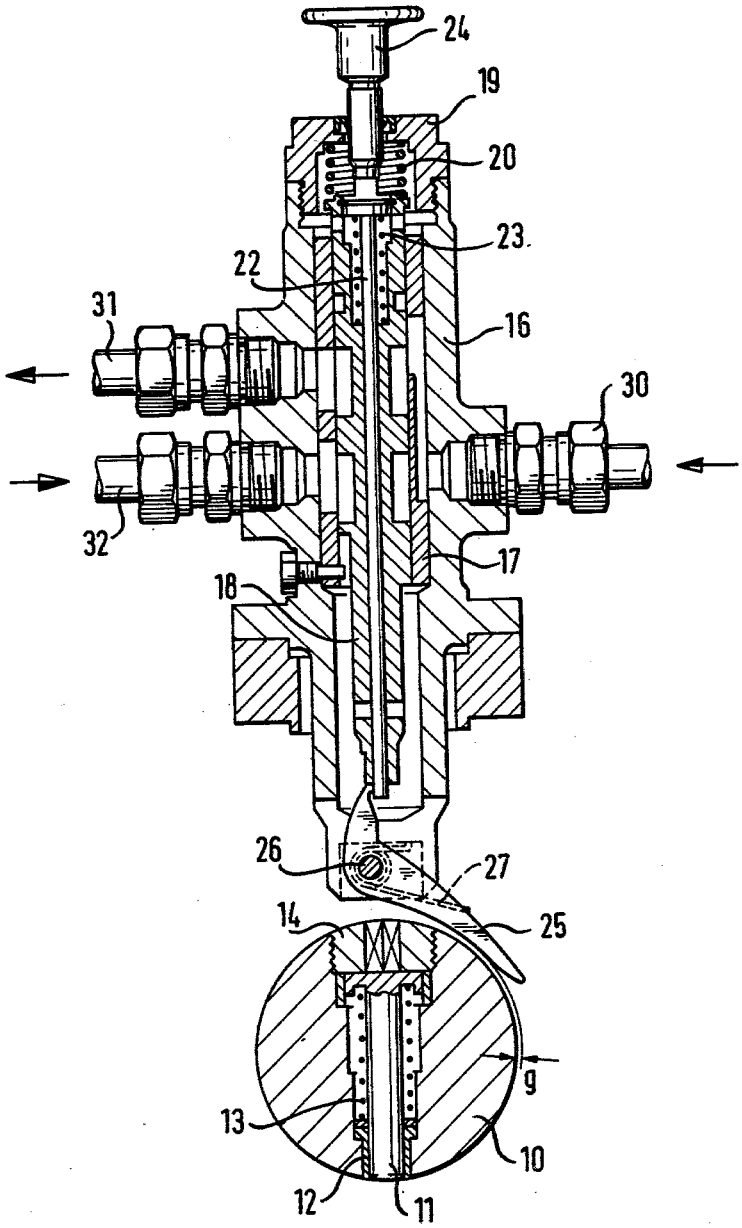
24
19
20
23
22
31
16
30
32
17
18
26
27
14
25
9
13
10
12
11

OPERATIVE MEMBERS FOR USE IN A QUICK SHUT-OFF APPARATUS

BACKGROUND OF THE INVENTION

1. Field of the Invention

The present invention relates to an operative member for use in a quick shut-off apparatus for a rotating machine.

2. Description of the Prior Art

In steam turbines, precautions must be taken, independently of the normal regulation of rotational speed, immediately to shut down the turbine if excessive rotational speed suddenly occurs as a result of, for example, a sudden shedding or decrease in load, or failure of a steam valve. For this purpose, a quick shut-off pin, held in position by a spring, is incorporated in the turbine shaft. Associated with the quick shut-off pin is a quick shut-off apparatus provided with a quick shut-off pawl, against which the quick shut-off pin impacts by centrifugal force if the quick shut-off rotational speed is reached. This initiates a control process which immediately shuts-off the steam feed to the turbine.

With increasingly higher rotational speeds for steam turbines and correspondingly higher quick shut-off rotational speeds, the quick shut-off pin will impact the quick shut-off pawl with very high force with consequent possible damage. It is known to use steel shut-off pawls which are coated with a spark-free layer at the part thereof impacted by the pin. While quick shut-off apparatus is provided for emergencies, it must withstand frequent quick shut-off trials during trial runs as well as during the normal operation of the turbine for checking safety apparatus against excessive rotational speed. Therefore, material strengths are required for the quick shut-off pawl which only conditionally still permit the use of steel since, at high quick shut-off rotational speeds, even steel pawls experience a plastic deformation because of the high force of impaction of the quick shut-off pin, especially when they are coated with spark-free material to avoid the danger of explosion. With the usual coating of spark-free material, such as brass, a copper-aluminum material or other commonly used materials, unacceptable damage may occur after a few impacts, and sometimes after even a single impact. Even when the spark-free coating can be dispensed with, quick shut-off pawls made of steel cannot be effectively used at quick shut-off rotational speeds above about 10,000 revolutions per minute since the steel pawls tend to deform plastically. At rotational speeds above 15,000 revolutions per minute, the deformation is so great that the pawl will be excessively deformed by the requisite testing operations.

SUMMARY OF THE INVENTION

According to the present invention there is provided an operative member or pawl for use in quick shut-off apparatus for a rotating machine, such as a steam turbine, the member being formed substantially of a solid material which is spark-free when subject to impact and in which:

$$K=(\epsilon\cdot\sigma)/(E\cdot\gamma)\geqq 3$$

where $\epsilon$ = the breaking elongation of the solid material in %;

$\sigma$ = the breaking stress of the solid material in Kp (kiloponds) per square centimeter;

E = the modules of elasticity of the solid material in Kp (kiloponds) per square centimeter; and $\gamma$ = the specific weight of the solid material in grams per cubic centimeter.

When the characteristic value given by the above equation is attained or exceeded on the basis of selected material properties, then the solid material is suitable for quick shut-off operative members or pawls in rotating machines in which the quick shut-off rotational speeds far exceed 10,000 revolutions per minute. The boundry value determined by the above equation ensures that the selected solid material withstands frequent impact without damage even at quick shut-off rotational speeds which lie far above the rotational speeds at which the prior steel quick shut-off pawls experience plastic deformation. The solid material may comprise a polyamide, and preferably is an extruded polyamide, in which case the member preferably is cut-out in the direction of extrusion.

A quick shut-off apparatus may comprise an operative member as defined above, a first element displaceable to a position in response to excessive rotational speed, the member being positionable to prevent, and pivotable in response to displacement of the first element to permit displacement of an elongated control element. The apparatus may further comprise a second element manually movable within the control element to pivot the operative member. The apparatus may also comprise spring means urging the operative member against the control element to prevent displacement thereof.

A steam turbine provided with the apparatus as defined above may comprise a quick shut-off pin member disposed in an opening in the turbine shaft and displaceable outwardly against a spring at a predetermined rotational speed of the shaft to cause pivoting of the operative member.

An object of the present invention is to provide an improved quick shut-off pawl formed of non-sparking material, which at very high quick shut-off rotational speeds and frequent quick shut-off initiation does not experience any permanent deformation.

An embodiment of the present invention will now be more particularly described by way of example and with reference to the accompanying drawing.

BRIEF DESCRIPTION OF THE DRAWING

The single FIGURE of the drawing is a cross-section through a quick shut-off apparatus incorporating the invention and the associated part of a turbine shaft.

DESCRIPTION OF THE PREFERRED EMBODIMENT

Referring now to the accompanying drawing, there is shown a quick shut-off pin 11 in a radial bore in a turbine shaft 10, pin 11 being urged against an abutment 14 by a guide bushing 12 and a spring 13 in such a manner that at normal rotational speed of the shaft 10, the quick shut-off pin 11 is held in the illustrated position by spring 13.

A control slide or valve spool 18 is guided to be displaceable in its axial direction within a control bushing 17 in quick shut-off actuator housing 16. The control slide 18 is urged downwardly by a spring 20 engaging a closure screw 19. A triggering pin 22, which at its lower end protrudes out of the control slide 18, is axially guided in the interior of the control slide 18. The upper end of the triggering pin 22 is engaged and urged upwardly by a spring 23 in a cavity in the control slide 18. The triggering pin 22 is manually displaceable downwardly within the control slide 18 against the force of the spring 23 by a handle 24.

A quick shut-off pawl 25 is pivotably mounted in the lower part of the actuator housing 16 by a pin 26, and a spring 27 acts on the pawl 25 with a pivotal force effective in clockwise direction as shown in the drawing. The quick shut-off pawl 25 has two arms, one shorter than the other. The shorter arm projects into the cavity in actuator housing 16 and has a nose which bears against the trigger pin 22 whereby the pivotal motion of the pawl 25 is limited in a clockwise direction. The control slide 18, urged by the spring 20, presses against the nose of the quick shut-off pawl 25 which is retained in the position shown in the drawing during normal operation. The longer arm of pawl 25 is normally disposed at a spacing "g" of approximately 1 to 1.5 millimeters from the surface of the turbine shaft 10. A control oil feed connection 30 as well as two connections 31 and 32 adapted to be connected to an oil-controlled shut-off valve for the turbine (not shown) are provided on the actuator housing 16.

When the rotational speed of the turbine shaft 10 reaches the predetermined quick shut-off rotational speed (clockwise rotation being shown), the quick shut-off pin 11 is displaced outwardly by centrifugal force against spring 13 and impacts against the longer arm of the quick shut-off pawl 25, which causes the pawl 25 to be pivoted in a counterclockwise direction. This permits the shorter arm or nose of pawl 25 to release the control slide 18 which is then displaced downwardly by the biasing force of the spring 20 to cause oil flow from the control oil feed connection 30 to the quick shut-off valve to be inhibited, which actuates rapid shutting-down of the turbine.

Quick shut-off may be initiated manually by displacing the trigger pin 22 downwardly against spring 23 by the handle 24 so that the trigger pin 22 forcibly engages an inclined surface on the shorter arm of the quick shut-off pawl 25. This causes the pawl 25 to be pivoted in the counterclockwise direction against the force of the spring 27 so as to disengage the control slide 18 thereby permitting the downward displacement of the control slide which thereby inhibits the control oil feed, as above described.

It will now be understood that at a high turbine quick shut-off speed, the quick shut-off pin 11 impacts the pawl 25 with high force, and the pawl 25 must therefore have high strength and sufficient resilience to absorb the impact energy without damage or permanent deformation. Materials suitable for quick shut-off pawls must be very hard as well as very stiff, and be highly resistant to thermal deformation, abrasion and plastic deformation. Also, such materials should be relatively light and ensure a spark-free impact on contracting metal so that a steam turbine provided with such pawls may be used where a spark may cause an explosion. A simple selection of materials is not possible since the properties of the individual constituents of a material influence the overall behavior of the material differently, and differently from material to material.

The evaluation of suitable pawl materials is provided by the invention to match these different influences through material magnitudes in such a manner that a statement can be made about the suitability of the material for quick shut-off pawls. When certain physical properties are set in relation with one another, then a characteristic value K can be stated, which must attain or exceed a certain magnitude in order to ensure that the material is suitable for quick shut-off pawls at high triggering rotational speeds. At the present high rotational speeds, this characteristic value K is determined by the formula:

$$K=(\epsilon\cdot\sigma)/(E\cdot\gamma)\geqq 3$$

wherein $\epsilon$ is the breaking elongation in %, $\sigma$ the breaking stress in Kp (kiloponds) per square centimeter, E the modulus of elasticity in Kp (kiloponds) per square centimeter, and $\gamma$ the specific weight in grams per cubic centimeter. It will be understood that the value K, whch is expressed as centimeters cubed ($cm^3$) per gram (g), is not a physical property or dimension.

It has been found that polyamides which have a relatively low specific weight and good resistance to oils, fats, most solvents, aqueous solutions and alkalis, attain this characteristic value K and thus are suitable. An example is a polyamide which is offered on the market by the firm BASF under the designation Ultramide A4, or by the firm Huls under the designation Vestamid L1901. For these polyamides the characteristic value K is approximately 4 or over. A solid material of such a polamide is able to withstand a multiplicity of impacts without damage even at rotational speeds of approximately twenty thousand revolutions per minute. Quick shut-off pawls formed substantially of these materials can be manufactured relatively inexpensively, and are less expensive than steel pawls. Furthermore, since polyamides are completely non-arcing materials, the difficulties associated with coating steel pawls to make them spark-free are avoided.

An advantage of the embodiment described above by way of example is that the quick shut-off pawl embodying the present invention is technically better and less expensive than prior pawls. Also, at very high quick shut-off rotational speeds and frequent quick shut-off operations the pawl does not experience any permanent deformation. Further, the pawl has a long operational life and may be used in an explosive environment, and/or an oil-stream saturated atmosphere, and/or a slightly hostile environment.

While the invention has been described in connection with quick shut-off apparatus for steam turbines, it is equally applicable to other rotating machines subject to excessive speed conditions.

While there have been described above the principles of this invention in connection with specific apparatus, it is to be clearly understood that this description is made only by way of example and not as a limitation to the scope of the invention.

What is claimed is:

1. An operative member for use in quick shut-off apparatus for a rotating machine, the member being formed substantially of a solid material which is spark-free when subjected to impact and for which:

$$K=(\epsilon\cdot\sigma)/(E\cdot\gamma)\geqq 3$$

where $\epsilon$ = the breaking elongation of the solid material in %

$\sigma$ = the breaking stress of the solid material in Kp (kiloponds) per square centimeter E = the modulus of elasticity of the solid material in Kp (kiloponds) per square centimeter and $\gamma$ = the specific weight of the solid material in grams per cubic centimeter.

2. The member of claim 1 wherein the solid material comprises a polyamide.

3. The member of claim 2 wherein the polyamide is extruded.

4. The member claimed in any one of claims 1, 2 or 3 wherein the member comprises a pawl.

5. The member of claim 3 wherein the polyamide is cut out in the direction of extrusion.

6. A quick shut-off apparatus for a rotating machine comprising a first element displaceable to a machine shut-off position in response to excessive rotational speed of said machine, an operative member formed substantially of a solid material which is spark-free when subjected to impact and for which:

$$K = (\epsilon \cdot \sigma)/(E \cdot \gamma) \geqq 3$$

where $\epsilon$ = the breaking elongation of the solid material in %

$\sigma$ = the breaking stress of the solid material in Kp (kiloponds) per square centimeter E = the modulus of elasticity of the solid material in Kp (kiloponds) per square centimeter and $\gamma$ = the specific weight of the solid material in grams per cubic centimeter, and an elongated control element displaceable to a machine shut-off position, said member having a first position engaging said elongated element to prevent displacement thereof, said member being pivotable to a second position in response to displacement of said first element to permit displacement of said elongated element.

7. The quick shut-off of claim 6 further comprising a second element manually displaceable within said control element and adapted to pivot said member.

8. The quick shut-off apparatus of either claim 6 or claim 7, further comprising spring means for urging said member toward said first position thereof.

9. The quick shut-off apparatus of either claim 6 or claim 7, wherein said first element comprises a pin member radially disposed in an opening in the shaft of said machine and displaceable at a predetermined rotational speed of the shaft to engage said member thereby to cause pivoting thereof to said second position.

10. The quick shut-off apparatus of claim 9 further comprising spring means restraining said pin member against displacement at speeds below said predetermined speed.

* * * * *